United States Patent [19]

Duer

[11] 4,002,104

[45] Jan. 11, 1977

[54] PISTON PUMP OR MOTOR HAVING INTERNAL FLUID FILTER

[75] Inventor: Morris J. Duer, Dayton, Ohio

[73] Assignee: General Motors Corporation, Detroit, Mich.

[22] Filed: May 5, 1975

[21] Appl. No.: 574,599

[52] U.S. Cl. ..... 91/499; 92/78

[51] Int. Cl.[2] ..... F01B 13/04

[58] Field of Search ..... 91/472, 499–507; 92/78

[56] References Cited

UNITED STATES PATENTS

| | | | |
|---|---|---|---|
| 846,226 | 3/1908 | Medlock | 92/78 |
| 1,289,168 | 12/1918 | Heginbottom | 92/78 |
| 2,300,009 | 10/1942 | Rose | 92/78 |
| 2,557,508 | 6/1951 | Leibing | 91/473 |
| 2,711,724 | 6/1955 | Jenny | 91/499 |
| 2,976,863 | 3/1961 | Duer et al. | 91/499 |

*Primary Examiner*—William L. Freeh
*Attorney, Agent, or Firm*—Donald F. Scherer

[57] ABSTRACT

A piston pump or motor in which each piston has a filter element disposed thereon between the fluid working chambers and the outer circumference of the piston. The filter element permits the passage of small amounts of fluid between the piston circumference and cylinder bore for proper lubrication and pressure balance while preventing solid foreign matter such as dust or grit from entering therebetween.

2 Claims, 2 Drawing Figures

PISTON PUMP OR MOTOR HAVING INTERNAL FLUID FILTER

This invention relates to piston pumps or motors and more particularly to piston pumps or motors having internal filtration elements.

Piston type pump and motors require that a small amount of fluid be permitted to leak past the piston between the piston and cylinder bore to provide proper lubrication and pressure balance. In some instances the fluid being circulated within the pump or motor contains smaller particles of solid foreign material which can become lodged between the piston and cylinder bore wall. This foreign matter produces an abrasive effect on the piston and/or cylinder block wall resulting in excessive wear and at times seizure of the piston within the cylinder bore. The result is damage to the pump or motor which requires repair. In the past full flow filters have been used to reduce this condition. However, the use of such filter results in flow efficiency losses within the system. The present invention will eliminate this contamination by providing a filter element secured to the piston member such that leakage fluid must pass through the filter element by passing through the space between the piston element without affecting flow efficiency.

The filter element is preferably made of felt, but may be comprised of any of the known filter materials which have sufficient properties to pass fluid but prevent the passage of solid materials. The filter element is preferably annularly or ring shaped and is retained on the piston by a retaining member which has a lip portion engaging the filter ring and is press fitted to or otherwise bonded with the interior portion of the piston.

It is an object of this invention to provide an improved piston type pump-motor having an internal filter element to prevent the collection of foreign matter between the piston and cylinder bore.

It is another object of this invention to provide an improved pump-motor in which an annularly shaped filter element is secured to the piston members to filter foreign matter from the leakage fluid which passes between the piston and cylinder bore.

Figure 1:
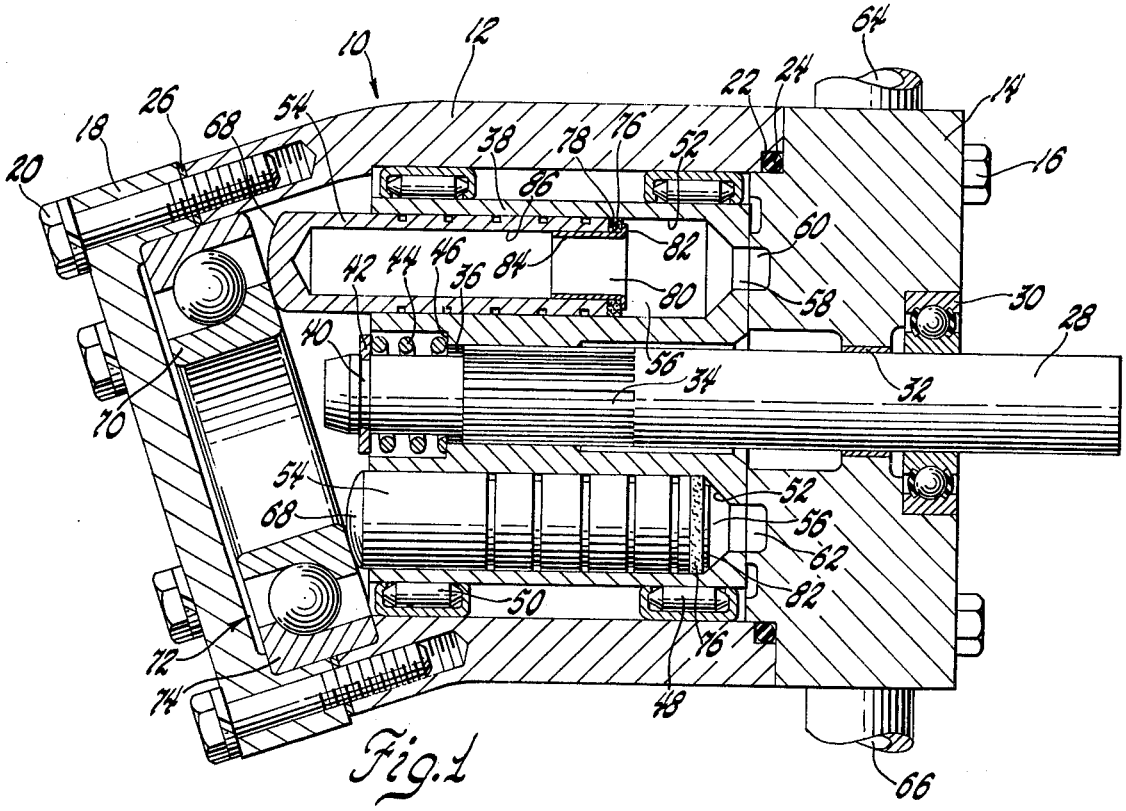
Figure 2:
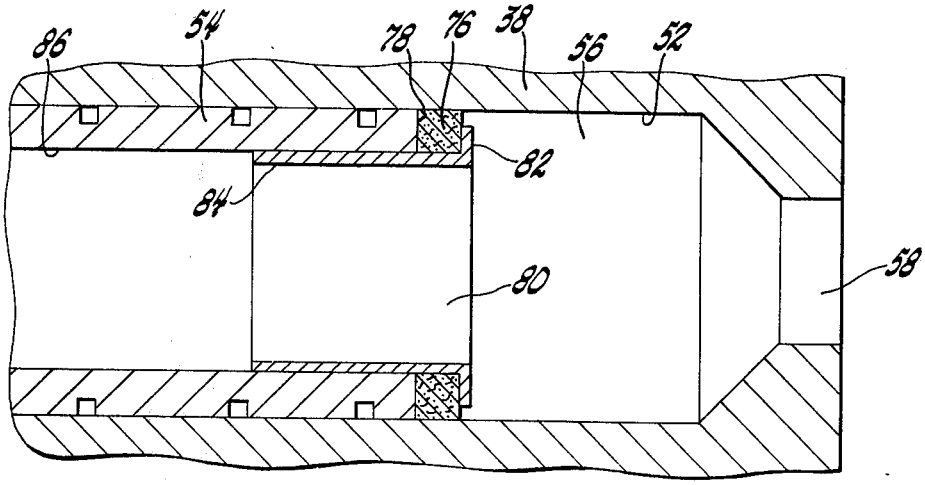

These and other objects and advantages will be more apparent from the following description and drawings in which:

FIG. 1 is a cross-sectional elevational view of a piston type hydraulic unit containing the present invention, and FIG. 2 is an enlarged view of a portion of FIG. 1 showing the filter element and its preferred embodiment.

Referring to the drawings wherein like characters represent the same or corresponding parts, there is shown a piston type hydraulic unit 10 which may be either a pump or motor. The hydraulic unit 10 has a main housing 12 to which is secured a valve cover 14 by a plurality of fasteners such as 16 and an end cover 18 which is secured to the housing 12 by a plurality of fasteners such as 20. The housing 12 has an annular groove 22 in which is disposed a sealed ring 24 which cooperates with the housing 12 and valve cover 14 to prevent leakage of fluid from the interior portion of the housing 12. The end cover 18 is separated from the housing 12 by a gasket 26 which prevents fluid leakage from the interior portion of the housing 12. This construction is similar to that shown in U.S. Pat. No. 2,976,863, issued Mar. 28, 1961, and assigned to the present assignee.

A shaft member 28 is rotatably and axially supported by a seal and bearing assembly 30, which assembly 30 is also secured in the valve cover 14. The shaft 28 is also rotatably supported in the valve cover 14 by a bushing 32. The shaft 28 has formed thereon a spline portion 34 which engages a mating spline portion 36 formed on a cylinder block 38. Also formed on the shaft 34 is a groove 40 in which is secured a retaining ring 42. A compression spring 44 is compressed between the retaining ring 42 and a shoulder 46 formed on the cylinder block 38. The spring 44 maintains the cylinder block 38 in sealing abutment with the valve cover 14.

The cylinder block 38 is rotatably supported in the housing 12 by a pair of roller bearings 48 and 50, and has formed therein a plurality of cylinder bores 52, each of which has slidably disposed therein a piston member 54. The pistons 54 and cylinder bores 52 cooperated to form fluid chambers 56. The fluid chambers 56 have an opening 58 which are placed in alternate fluid communication with substantially semiannular grooves 60 and 62 which grooves are in fluid communication with passages 65 and 66 respectively through internal passages, not shown, formed in valve cover 14.

The pistons 54 have a spherical end surface 68 which abuts the inner race 70 of a bearing 72. The outer race 74 of bearing 72 is secured in the end cover 18 and housing 12. As is seen in FIG. 1, the bearing 72 is disposed obliquely to shaft 28 such that, when shaft 28 is rotated, the pistons 54 are forced to reciprocate but then the cylinder bores 52 thus resulting in expansion and contraction of the fluid chamber 56. Thus the bearing 72 provides a camming action which is well known in the hydraulic piston unit art.

Also, as is well known in the art of piston pumps and motors, when the shaft 28 is rotated by an external power source, fluid is transmitted to and from the fluid chambers 56 by the reciprocation of the pistons 54. For example, fluid passage 66 can be connected to a reservoir and passage 64 can be connected to a system to be pressurized such that when the shaft 28 is rotated fluid will be drawn into the chambers 56 through passage 66 and will be discharged from chambers 56 to chamber 64. When the hydraulic unit 10 is operated as a hydraulic motor, fluid pressure is directed through one of the passages 66 or 64, depending on the direction of rotation of shaft 28, to chambers 56. Fluid pressure therein results in expansion of the chamber 56 and rotation of the cylinder block 38 and therefore shaft 28. After the work has been performed by the fluid on pistons 54 it is expelled through the low pressure passage which is either 64 or 66 depending on the rotation of shaft 28.

It is also known that the high pressure in chamber 56 will leak between the piston 54 and the cylinder bore 52 since some clearance must be provided to permit the relative movement between these two parts. To prevent solid foreign matter from being carried from the fluid chamber 56 between the piston 54 and cylinder bore 52 an annular filter element 76 is disposed in abutting relationship with the end 78 of piston 54, as seen in FIG. 2. The annular filter element 76 is retained on the piston 54 by a retaining member 80 which has a lip portion 82 and a cylindrical body portion 84. The cylindrical body portion 84 is press fitted in a cylindrical opening 86 formed in the interior portion of piston 54. When the cylindrical portion 84 is pressed into opening 86, the lip portion 82 will engage the filter element 76 providing slight compression thereof and also causing the filter element 76 to be deformed outwardly against the surface of bore 52. Thus the filter element is maintained in contact with the bore 52 and the piston 54 in such a manner as to prevent foreign matter from being carried by the leakage fluid which passes between the cylinder bore 52 and the piston 54. Preferably the filter element 76 is made of felt material, however, any of the known filter materials can be used provided they have sufficient filtering ability to prevent the minute solid particles carried by the hydraulic fluid from entering between the piston 54 and cylinder bore 52.

Obviously, many modifications and variations of the present invention are possible in light of the above teachings. It is, therefore, to be understood that within the scope of the appended claims the invention may be practiced otherwise than as specifically described.

What is claimed is:

1. A piston pump or motor comprising; a housing, a cylinder block rotatably disposed in said housing including a plurality of axially extending cylinder bores disposed therein; a plurality of pistons each slidably disposed in a respective cylinder bore of said cylinder block and cooperating therewith to form a respective fluid chamber and each piston having an interior opening; a cam disposed in said housing in abutting relation with said pistons to urge said pistons into said cylinder bores to induce fluid flow to and from the fluid chambers upon rotation of said cylinder block; and filter means disposed on each of said pistons for filtering foreign matter from fluid leaking between said pistons and bores into said housing from said fluid chambers including a ring of filter material abutting the piston face adjacent said fluid chamber and being in contact with said cylinder bore, and retaining means disposed in interference fit relation with the interior opening of said piston and having a lip portion securing said ring to said piston.

2. A piston pump or motor comprising; a housing; a rotatable cylinder block means disposed in said housing and having cylinder bore means; piston means reciprocably slidably disposed in said cylinder bore means including an outer cylindrical surface slidably adjacent said cylinder bore means, and inner cylindrical opening, and an end face; expansible fluid chamber means formed by said piston means and said cylinders bore means adjacent said end face; drive means operatively connected for rotation with said cylinder block means and for enforcing reciprocation of said piston means; and fluid filter means including annular filter material means disposed in abutting relation with said end face and contacting said cylinder bore, and retainer means secured in said inner cylindrical opening and having a lip portion engaging a portion of said annular filter material means for retaining said annular filter material means on said piston means.

* * * * *